United States Patent [19]

Gerber

[11] 3,941,955

[45] *Mar. 2, 1976

[54] ELECTRIC LOCK AND KEY ASSEMBLY

[75] Inventor: Richard W. Gerber, West Des Moines, Iowa

[73] Assignee: Gerber Electronic Lock, Inc., Des Moines, Iowa

[ * ] Notice: The portion of the term of this patent subsequent to Feb. 19, 1991, has been disclaimed.

[22] Filed: Dec. 17, 1974

[21] Appl. No.: 533,720

Related U.S. Application Data

[62] Division of Ser. No. 401,991, Oct. 1, 1973, which is a division of Ser. No. 214,675, Jan. 3, 1972, Pat. No. 3,793,500.

[52] U.S. Cl. ..... 200/44; 317/134

[51] Int. Cl.[2] ..... H01H 47/00

[58] Field of Search ..... 200/42 R, 44; 307/10 AT; 180/114; 340/64; 317/134, 135 A

[56] References Cited

UNITED STATES PATENTS

| | | | |
|---|---|---|---|
| 3,348,220 | 10/1967 | Luna et al. | 200/44 |
| 3,415,087 | 12/1968 | Kruasz, Jr. et al. | 200/44 |
| 3,441,808 | 4/1969 | Crane | 317/135 A |
| 3,631,301 | 12/1971 | Goldman | 317/134 |
| 3,644,745 | 2/1972 | Bell | 200/42 A |
| 3,731,156 | 5/1973 | Watson | 317/135 A |
| 3,749,930 | 7/1973 | Roe | 317/134 |
| 3,793,500 | 2/1974 | Gerber | 200/44 |

*Primary Examiner*—Herman Hohauser
*Attorney, Agent, or Firm*—Zarley, McKee, Thomte & Voorhees

[57] ABSTRACT

An electrical lock assembly which includes within a lock housing a set of flexible electrical key contacts and a set of electrical unlock contacts mounted in the lock housing and located proximate to the key contacts. A key directly engages the flexible key contacts and presses them directly against the unlock contacts thereby completing an electrical circuit between the key contacts and the unlock contacts. An unlock circuit means electrically connected to the unlock contacts is responsive to the completion of a circuit between the key contacts and the unlock contacts. In another embodiment the lock assembly includes flexible alarm contacts which are pressed against a second set of alarm contacts to activate an alarm circuit when an improper key is employed.

6 Claims, 10 Drawing Figures

ELECTRIC LOCK AND KEY ASSEMBLY

CROSS-REFERENCE TO RELATED APPLICATIONS

This application is a division of Ser. No. 401,991, filed Oct. 1, 1973, which is a division of Ser. No. 214,675, filed Jan. 3, 1972, now U.S. Pat. No. 3,793,500.

BRIEF DESCRIPTION OF THE DRAWING

FIG. 9 also show the door locking plunger unlocking solenoid of FIG. 3 and e portion of its plunger.

DESCRIPTION OF THE PREFERRED EMBODIMENT

Figure 1:
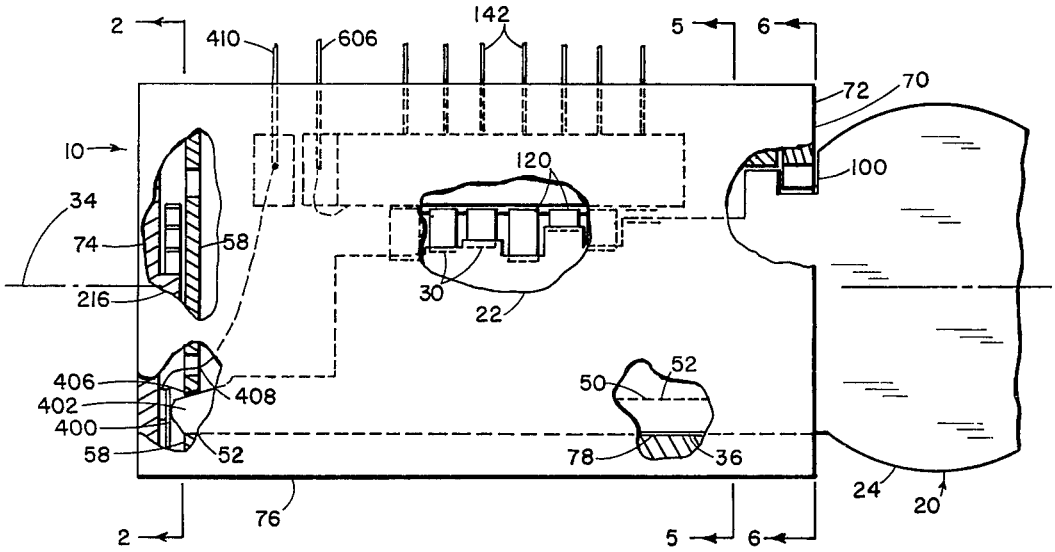
FIG. 1 is a side elevation of the electrical lock and key assembly of this invention, shown with the key in a vertical plane position of insertion, and with various parts of the housing broken away to show interior parts, some of which are shown in cross section, certain other interior parts being indicated in dotted lines.

Referring to FIG. 1 the electrical lock and key assembly of this invention is there generally shown at 10, and comprises a key 20 having a forward insertion section 22 and a rearward handle section 24.

The key 20 has on the exterior of its insertion section 22 a plurality of raised portions of protrusions 30, which latter extend outward various distances from an axis of rotation 34 of the key and likewise respective distances from a guided surface of the key, which latter surface can be the undersurface 36 of the key. The guided surface or undersurface 36 extends forwardly and rearwardly along the key 20.

A key guide 50 has a slot 52 extending from the forward to the rearward end thereof. The slot 52 is upwardly opening and has vertical parallel side surfaces which can be called guide surfaces 54, which latter are ordinarily in guiding relationship or guiding engagement with the guided surface or undersurface 36 of the key 20 for directing the key lineally upon insertion of the key into the guide 50.

The guide 50 has a bottom portion 56 which interconnects two cylindrical end portions, a forward cylindrical end portion 57, and a rearward cylindrical end portion 58.

An outer housing 70 is provided having forward and rearward end walls 72 and 74 interconnected by a cylindrical central portion 76, which latter is concentric about the axis 34 of rotation of the key. The central portion 76 of the housing is cylindrical not only on its outer side but also on its inner surface 78, which latter receives the cylindrical forward and rearward end portions 57 and 58 of the guide 50 slidably thereagainst so that the guide 50 also rotates about the axis 34.

Figure 5:
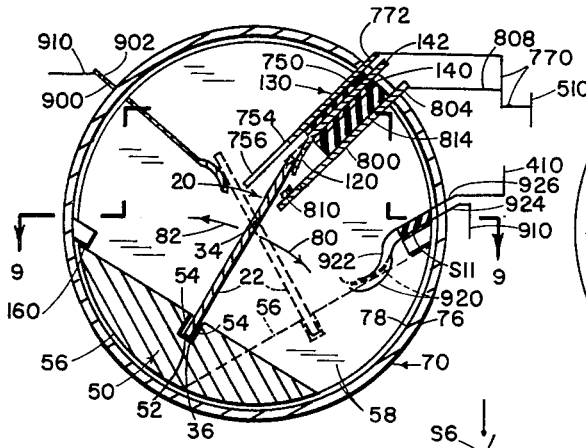
FIG. 5 is a sectional view of this invention taken along the line 5—5 of FIG. 1, having front and back contact assembly electrical alarm plates being shown in cross section, a dotted position of the key being shown in engagement with a relocker contact, which latter is shown as connected to the door plunger locking solenoid.

As best seen in FIG. 5, the key 20, if twisted, can define a movement in a clockwise direction or counterclockwise direction, as seen from the right end of FIG. 1. The clockwise direction is indicated by the arrow 80 in FIG. 5 and the counterclockwise direction by the arrow 82.

Figure 6:
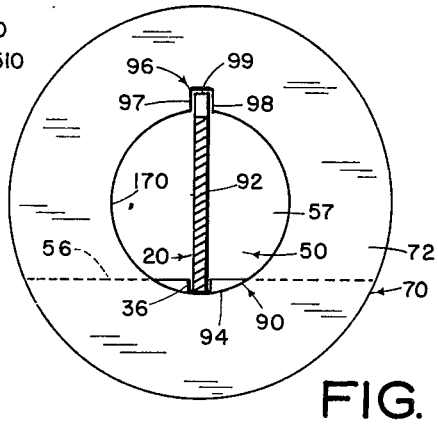
FIG. 6 is a sectional view taken along the line 6—6 of FIG. 1 and showing a notch system in the outer housing for preventing the key from being rotated except when it is fully inserted.

As best seen in FIG. 6, once the key is inserted through a keyhole 90 in the forward end 72 of the housing 70, as is made possible by a vertically elongated chamber entrance 92 extending through the end wall 57 of the guide 50, whereby the key and the key guide 50 can both be rotated clockwise or counterclockwise with respect to the housing 70.

Referring to FIG. 6, the keyhole 90 can be said to have a main portion 94, and there is a small recess 96 in the upper wall of the main keyhole portion 94, the recess 96 having opposed spaced wall portions 97 and 98 closesly and slidably receiving an edge portion 99 of the key 20, the edge portion 99 being the upper edge portion.

As best seen in FIG. 1, the upper edge portion 99 of the key has a notch 100 therein which is disposed opposite the walls 97 and 98 of the recess 96 so that as the key is rotated, the notch will receive the walls 97 and 98 permitting the key to be rotated. But it will be seen that this can only happen when the key is fully inserted into the housing 70 with the exception of its enlarged outer end 24. This is because the notch 100 is opposite the recess surfaces 97 and 98 only when the key is fully inserted.

The purpose of this is to assure that the operator inserts the key fully so that it can be rotated because this full position of insertion must be achieved in order to place the protrusions 30 opposite mating contacts 120 of a contact assembly 130.

The contact assembly 130 has a row of contacts thereon disposed side-by-side and extending in a plane extending forwardly and rearwardly with respect to the outer housing and disposed at an acute angle of about 40° with respect to the vertical, by way of example, and extending inwardly toward a center of the cylindrical surface 78 of the inner side of the outer housing. The contacts 120 are insulated from each other by either air space or insulation, and preferably they are held together by insulation, best seen in FIG. 5 at 140, and which is attached to the outer housing for holding the contact assembly in place with terminals 142 extending completely through the housing from each of the contacts 120, as best seen in FIG. 5. Each of the contacts 120 can be made of flexible material such that its inner end is adapted to flex somewhat as the key 20 engages it and is best seen in FIG. 5 in full lines, although the dotted line position of the inner end of a contact 120 shows the relaxed and normal position of a contact.

A stop 160 is attached to the inner side of the outer housing in a position for engaging an upper surface of the central portion 56 of the rotating guide 50 at a time when the key is rotated clockwise, as seen in FIG. 5, sufficiently for its protrusions to have contacted the mating contacts 120, but preventing further clockwise rotation of the key so as to prevent the contacts 120 from being broken off.

Rotation of the key is impossible except when it is fully inserted and, for that reason, the walls 97,98 of the recess 96 and also the entire annular circular portion of the end wall 72 of the housing 70 can altogether be called the blocking means 170 and blocks rotation of the key when it is less than fully inserted.

Figure 2:
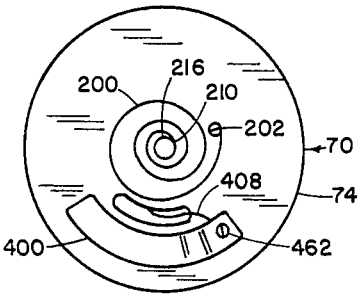
FIG. 2 is a sectional view taken along the line 2—2 of FIG. 1.

Referring to FIG. 2, a rearward biasing spring 200 of a spiral configuration has its outer end anchored to the rearward side of the rearward wall 58 of the guide 50 and has its inner end suitably secured by means at 210 to a boss 216 which protrudes inwardly from the center of the rearward wall 74 of the outer housing 70, the boss 216 also serving to space the guide from the wall 74 to provide room to accommodate the spring 200.

The rearward biasing spring 200 constantly urges the key toward a vertical planar position of original insertion to cause it to return from a position of contacting the contacts 120.

Figure 7:
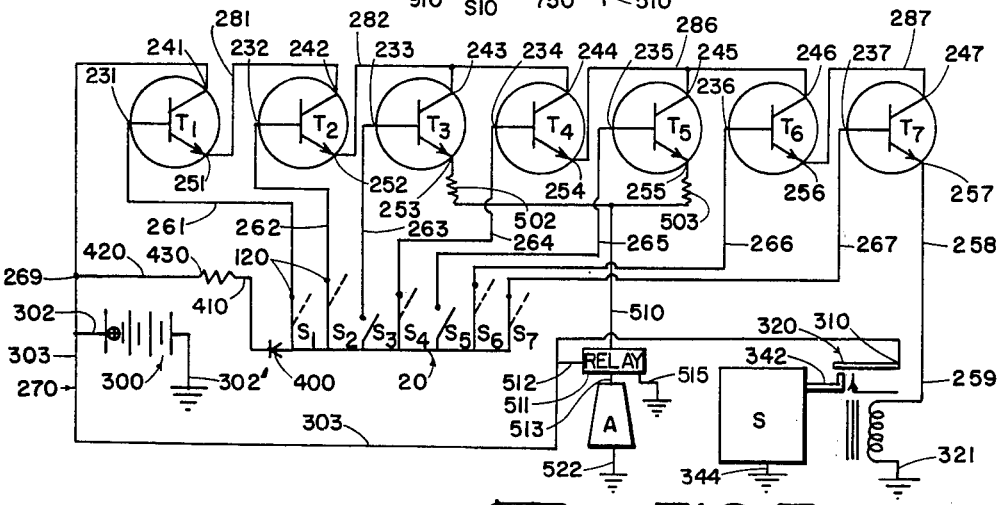
FIG. 7 is a wiring diagram showing how contacts of the contact assembly of FIG. 1 are connected through transistors to a target circuit and also how special contacts on the contact assembly are connected through transistors to an alarm circuit.

In FIG. 7 is a wiring diagram in which a plurality of switches are shown at $S_1$, $S_2$, $S_3$, $S_4$, $S_5$, $S_6$ and $S_7$, each of these swltches representing the connection made when one of the protrusions 30 of the metallic conductive key 20 touches one of the mating contacts 120 of the contact assembly 130.

In FIG. 7 a plurality of electronic switching means are shown and illustrated by transistors $T_1$, $T_2$, $T_3$, $T_4$, $T_5$, $T_6$, and $T_7$, respectively, each of which has a base or first terminal 231, 232, 233, 234, 235, 236 and 237, respectively; and each having a collector or second terminal 241, 242, 243, 244, 245, 246 and 247, respectively; and each having a third or emitter terminal 251, 252, 253, 254, 255, 256 and 257, respectively.

The transistors $T_1$ to $T_7$ are sequentially arranged $T_1$ being the first and $T_7$ being the last, and the first terminal 231 to 237 respectively of each of the transistors is connected each to a terminal 142 of a different one of the switches $S_1$ to $S_7$, this being accomplished by wires in the sequence 261 to 267, respectively.

The second or collector terminal 241 of the first transistor $T_1$ is connected to a terminal 269 of a target circuit 270 to be later described.

The third terminal 251 of the first of the transistors $T_1$ is connected by a wire 281 to the second or collector terminal of the second transistor $T_2$. A wire 282 connects the third or emitter terminal 252 of the second transistor $T_2$ to the second or collector terminals 243 and 244 of the transistors $T_3$ and $T_4$.

The third terminal 254 of transistor $T_4$ is connected by a wire 286 to the second or collector terminals of the transistors $T_5$ and $T_6$. The third or collector terminal 256 of the transistor $T_6$ is connected by a wire 287 to the second or collector terminal 247 of the transistor $T_7$.

The target circuit 270 has in it a source of electrical power illustrated by an automobile battery 300, which latter has a grounded terminal 302' and has its other terminal connected by a wire 302 to a wire 303, which latter is connected to the terminal 269, which latter can be considered one of the terminals of a target circuit 270.

The wire 303 is connected to one of the terminals 310 of a relay 320, which latter has its other terminal grounded at 321. The relay 320 may be for the purpose of permitting current from the wire 303 to reach a solenoid S which latter is connected to the relay at 342 and has its other terminal grounded at 344.

Figure 3:
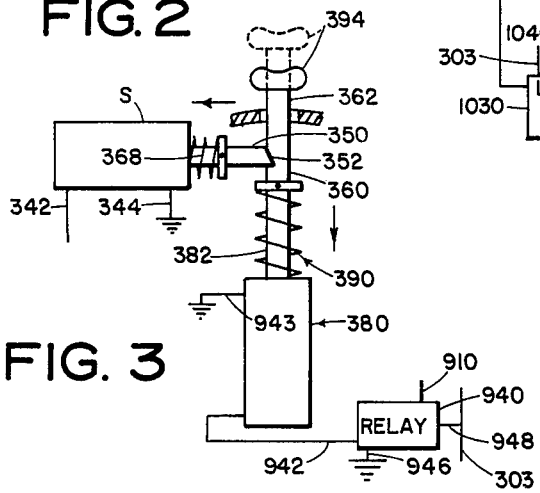
FIG. 3 is a view of a sample door locking plunger assembly with a door locking and unlocking plunger splenoid system of this invention mounted thereon.

The solenoid S can be an unlatching solenoid for door unlatching and is seen in FIG. 3, the solenoid S appears again in more complete detail showing its core 350 extending outwardly and into a notch 352 of a plunger 360 of a door-locking mechanism generally indicated at 362.

The core 350 is urged continually toward a locking relationship with respect to the plunger 360 by means of a spring assembly 368.

The door-locking plunger 360 is adapted to be automatically locked by means of a locking solenoid 380, which latter has a core 382 suitably attached to the plunger 360 for causing reciprocatory movements thereof. The core 362 of the solenoid 380 urges the plunger 360 upwardly whenever the solenoid 380 is not energized because of the action of a spring assembly 390 associated with the core 382 and solenoid 380. But when the solenoid 380 is energized, the plunger 360 will move downwardly from the dotted line position of its top 394 to the full-line position of its top and as shown in FIG. 3 for causing door locking. The remainder of the door-locking mechanisms associated with the plunger 360 are not shown since they are all common and the plunger 360 will itself be recognized as being of the type which commonly protrudes form the upper side of the door of an automobile or usually pushed downward by the finger of an operator.

In the wiring diagram of FIG. 7, the line indicated at 20 represents the conductive key itself with its inner end touching and making contact with an end contact 400 seen in FIGS. 1 and 2, which latter is resilient and elongated and is attached by a securing means 402 to the rear end wall 74 of the housing.

The end contact 400 is of a size for extending along substantially a 45° segment of a circle on the axis 34 so as to be in contact with an inner end portion 402 of the key 20 as the key rotates and as later described.

As best seen in FIG. 1, this inner end portion 402 extends through an opening 406 in the cylindrical rearward end portion 58 of the guide 50 so as to permit it to engage the end contact 400.

Figure 9:
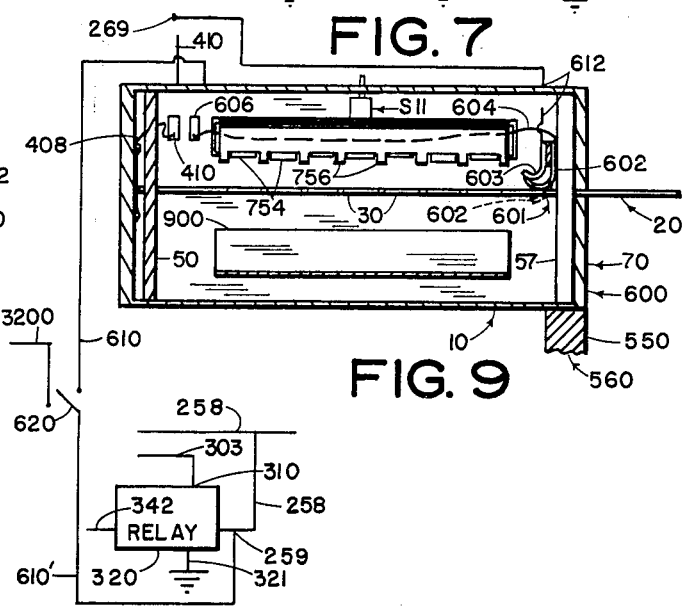
FIG. 9 is a top plan view of the lock and key assembly of FIG. 1, with the top half of the outer housing removed for showing the contact assembly and particularly for illustrating a special conductive device used, only when the lock and key assembly is used as an ignition switch, for engaging a metallic key whenever the key is in the key receiving means to prevent doors from being locked when the key is in the ignition switch.

In FIGS. 1, 2 and 9, a wire 408 can be seen leading from the end contact 400 to the key energizing terminal 410 which is suitably mounted on and extends through the outer housing 70.

In FIG. 7, a wire 420 connects the terminal 269 of the target circuit 270 to a resistor 430, which latter protects the transistors $T_1$ to $T_7$ from excessive current, the resistor 430 being connected to the inner end of the metallic key 20 by means of the end contact 400, but also by means of two elements not shown in FIG. 7, namely, the wire 408 and the key energizing terminal 410, seen in FIGS. 1 and 9.

Referring to FIG. 7, the emitter or third terminals 253 and 255 of the transistors $T_3$ and $T_5$ are shown as connected to suitable resistors 502 and 503 respectively.

A wire 510 leads from the resistors 502 and 503 to a terminal of a relay 511 which latter has a terminal 512 connected to the heavy current wire 303 and an output terminal for heavy current at 513 connected to an electrical alarm A grounded at 522. The relay 511 is grounded at 515.

The alarm A can be of any signalling or humanly sensible type such as an audible alarm different from the automobile horn or it can be the automobile horn itself.

In operation, the circuit of FIG. 7 and lock and key assembly 10 of FIG. 1 will begin operation upon insertion of the key 20 through the outer housing 70 at the key-hole 90 while the key is held in the vertical plane in the example shown.

Rotation of the key toward the contact plate 130 will not be possible until the key has been fully inserted because it is only in that position that the notch 100 in the key will be opposite the walls 97 and 98 of the key recess 96. Since full insertion is thus made easy for the operator to recognize, the inner end 402 of the key will then surely be in contact with the end contact 400 for the operation of the circuit of FIG. 7. When the key has its protrusions 30 in engagement with the flexible mating contacts 120 of the contact assembly 130, then because it is the proper key, only the contacts 120 of the switches $S_1$, $S_2$, $S_4$, $S_6$, and $S_7$ will be engaged by protrusions of the key and the contacts 120 of the contact assembly 130 which form terminals of the switches $S_3$ and $S_5$ will not be engaged by protrusions of the proper key.

As thus described, all of the transistors which can be called target circuit operating transistors $T_1$, $T_2$, $T_4$, $T_6$ and $T_7$ are operated for delivering current from the third or emitter terminal 257 of the transistor $T_7$ through a wire 258 to the solenoid terminal 259 of the relay 320 for operating the relay 320 so that it energizes the solenoid S, which latter, as seen in FIG. 3 will then retract its core 350, whereby the spring 390 will cause the door-locking plunger 360 to move upward into unlocked position, shown in dotted lines in FIG. 3.

However, the operation of an unauthorized or foreign key, not shown, is different. The foreign key would possibly have protrusions in the wrong places which would then engage those contacts 120 which form parts of the switches $S_3$ and $S_5$ of FIG. 7, whereby one or both of the transistors $T_3$ and $T_5$ would be energized in accordance with whether one or both of the switches $S_3$ and $S_5$ are energized respectively, whereby the transistors $T_3$ or $T_5$, or both, would deliver current to the audible alarm 520 which would make a loud noise sounding substantially different than ordinary automobile horns, indicating that a theft has been taking place. It is possible, however, for the alarm 520 to actually be the automobile horn itself, or to be an alarm means of any kind that is sensible in any way.

It is understood that FIG. 7 is only an illustration. Any numbers of transistors may be used, and also, instead of transistors, the electronic switching means used can be switching diodes or relays.

To prevent the locking of the automobile doors when the key has been left in the ignition switch, a special system is used as illustrated in FIG. 9 in which the entire electrical lock and key assembly is being used as an ignition switch in an automobile, whereby the outer housing 70 is mounted in the dashboard of the automobile of which a portion is shown at 550 in FIG. 9, the automobile itself not being shown, with the exception of the numeral 560 indicating the automobile broadly as represented by the dashboard portion 550.

The understanding of FIG. 9 is best accomplished by realizing that FIG. 9 is a composite view, since most of the parts of FIG. 9 are useful as an ignition switch, but FIG. 9 also illustrates the position of a door-locking contact 900 and of a substitute modification door-locking switch S11, both of which are later described herein and are used only when the switch is used as a door lock and are not used when the switch is used as an ignition lock. Most parts which are peculiar to my new electrical lock when this electrical lock is used as an ignition lock to be found in FIG. 4. But an exception to this is the feature of a later described lock-out prevention switch generally indicated at 601 in FIG. 9.

The purpose of the lock-out prevention switch 601 is to prevent an operator from becoming accidentally locked out of his car by shutting and locking his door while his keys are at his ignition switch as later described in detail.

The lock-out prevention switch 601 is in electrical association with the door-unlocking solenoid S of FIG. 3, although this association is indirectly through the relay 320 which controls the door locking solenoid S as later described.

Referring to FIG. 9, a system for preventing doors from being accidentally locked while the key remains in the ignition is now to be described. For this system, the lock and key assembly 10 in FIG. 9 is to be considered to be an ignition switch mounted in the dashboard of an automobile, the dashboard being indicated at 550 and the automobile being indicated generally at 560 as represented by that portion thereof which is the only part shown, namely, the dashboard portion.

The key guide 50 and the outer housing 70 together define a key-receiving and housing assembly 600 on which a circuit-closing device generally indicated at 601 is mounted in the position for being engaged by the key 20 at a time when the key 20 is but slightly inserted into the housing 70 so that it is substantially impossible for the key to be in an ignition switch without engaging the circuit-closing assembly 601.

The circuit-closing assembly 601 comprises a key-engaging member 602 which is formed of resilient, springy conductive material having one end suitably mounted on the inner side of the cylindrical end wall 57 of the guide 50. The circuit-closing assembly 601 further comprises a conductive engaged means 603 which is disposed on the side of the outer end of the key-engaging means 602 which faces away from the key, the positions being such that when the key is in a certain position shown in FIG. 9, it will engage the key-engaging means 602 causing it to flex from a dotted line position shown in dotted lines at 602 to a full-line position in which latter it contacts the conductive engaged means 603 and it is to be understood that the key-engaging means 602 does not engage the conductive engaged means 603 except at times when the key 20 is inserted whereby it has pressed the key-engaging means 602 into the full-line position shown in FIG. 9.

A wire 604 leads from the key-engaging means 602 to a lead 606 which extends through the housing 70 and which is connected by a wire 610 to the terminal 259 of the relay 320.

A second wire from the circuit-closing assembly 601 leads from the conductive engaged means 603 and can be seen at 612 in two separated parts since it actually extends through that part of the housing 70 which has been broken away in FIG. 9, and so the wire 612 extends to the terminal 269 where it causes the circuit-closing assembly 601 to have the effect of conducting current from the terminal 269 over to the relay terminal 259 for energizing the relays so that it tends to hold the solenoid S energized so that it releases the door plunger and maintains it released until such time as the key has been removed from the ignition switch.

This will tend to prevent a person from being locked outside of his car at a time when his ignition key is in the ignition having attached to it probably his door-unlocking key.

A variation has a switch 620 in a wire 610, the switch 620 being a manual switch somewhere in the dashboard area and known to the driver so that if there are times when he wishes to drive the automobile through a dangerous area and wants the doors to be locked at the same time, he can simply open the switch 620 making a disconnection along the line 610 to temporarily place this circuit-closing assembly 601 out of action so that the doors can remain locked.

An alternate way of setting off the alarm 520 is shown in FIG. 5 in which a conductive alarm associated plate shown at 750 is arranged in disposition closely adjacent to, but not in, the swaths of motion of at least some of the protrusions 30 and in a plane disposed with respect to the outer housing 70 closer to the insertion or vertical position of the key with respect to the swath of motion of the key as it moves toward the contact assembly 130 than is the position of the contacts 120 themselves with respect to the key insertion or vertical position.

The alarm associated plate or front plate 750 has many notches 754 therein of a size for permitting respective protrusions to pass therethrough on their way to the respective contact 120. In another sense, the alarm associated plate 750 has between its notches 754 a plurality of spaced downwardly extending fingers 756 formed integrally with the conductive plate material of the alarm associate plate 750. Whenever an unauthorized or foreign key is inserted into the lock, there are so many of these fingers 756 which can be engaged by one of the protrusions of the key which do not match the notches 754 in the front alarm associated plate that an alarm means attached to the plate 750 will very likely be energized. The specific alarm means is not shown in FIG. 5, but can be the alarm A of FIG. 7, as is energized by circuit means now to be described.

A wire 770 is connected to a terminal 772 of the alarm plate 750, which latter extends beyond the outer housing 70. The wire 770 is connected to the wire 510 of FIG. 7 for operating the relay 511 to energize the alarm A. A wiring diagram showing this can be found in FIG. 5A in which a switch S-9 is shown of which the switch throw is to be considered to be whatever portion of the key 20 which touches the alarm plate 750 and which the other terminal of the switch S-9 is considered to be the plate 750 itself.

Referring to FIG. 5, it will be seen that a back alarm associated plate 800 is mounted on the inner side of the outer housing 70 in a position on the opposite side of the key protrusions 30 from the mating contacts 120. The back alarm associated plate 800 extends generally toward the axis 34 of the switch a greater distance than the front alarm associated plate 750, whereby, if the protrusions of the foreign key disposed in the lock pass beneath the fingers 756 of the front alarm plate 750 and also pass by the contacts 120, then they will touch the back alarm associated plate 800 causing energy to pass through the same to its terminal 804, which latter is connected by a wire 808 to the wire 770 for indirectly operating the alarm A in the same manner as does a key contact with the front alarm associated plate 750. A small extension 810 is disposed on the key side of the back alarm associated plate 800 so that the extension 800, which is conductive, and which is conductively attached to the plate 800 will be engaged before key rotation is stopped by the engagement of the central part 56 of the guide with the stop 160 of FIG. 5.

The back alarm associated plate 800 is separated by insulation 814 from the contacts 120 and parts electrically connected thereto.

Figure 5A:
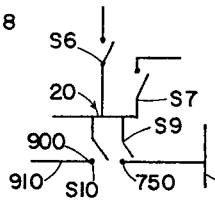
FIG. 5A is a wiring diagram showing how front and rear conductive alarm associated plates and also how a doorlocking contact of the switch are wired into the circuit of FIG. 7.

Referring to FIG. 5, when it is desired to lock a door automatically, the key is turned so that its inner end 22 is disposed in the dotted line position of FIG. 5 and in contact with a locking contact 900 which is attached to the housing 70 and extends inwardly therefrom in a position to be engaged by the key 20 at times when the key has been turned counterclockwise through an acute angle of perhaps 35°. A terminal 902 attached to the locking contact 900 extends through the housing 70 and has a wire 910 attached to it, which latter can also be seen in FIG. 5A in which a switch S10 in the wiring diagram of FIG. 5A represents the switching contact made between the key 20 and the locking contact 900. The entire key is not diagrammed in FIG. 5A and the method of showing the switches S9 and S10 as coming directly from a line extending horizontally at points inbetween the positions $S_6$ and $S_7$ is a device used to indicate that it is not the protrusions necessarily which cause operation of the switches S9 and S10, but rather any part of the key can close the switches, and it is preferable that the locking contact 900 and also the back alarm associated plate 800 extend far enough downwardly so as to engage a key along its main portion below its protrusions, although this is not necessary if the locking contact 900 is of a great width in a direction along the axis 34, since it would touch one of the other of the contacts of the proper key anyway.

Switches S9 and S10 depend for their operation upon an energized conductive key 20. But an alternate locking switch is shown at S11 which is intended for use in situations in which the key can be either conductive or non-conductive. The switch S11 has two contacts 920 and 922, both of which are elongated and resilient and extend alongside one another. The contact 920 is disposed closer to the top of the central section 58 and is adapted to be pressed upward in a normal position shown in dotted lines in FIG. 5 into the full-line position thereshown, in which latter the contact 920 engages the contact 922 closing the switch, although the contact 920 is not in engagement with the contact 922 whenever the central section 58 is not in engagement with the contact 920.

Upper ends of the contacts 920 and 922 are suitably insulated from each other by insulation means 923 and terminals attached thereto extend through the outer housing 70, as seen at 924 and 926 respectively.

An understanding about how switch S11 would work can be had by considering FIGS. 5, 5A, and 7 together in which it is understood that a terminal 926 of the switch S11 is connected to the wire 410 which leads from the resistor 430 of FIG. 7 through a wire 401 seen in FIG. 1 and FIG. 7 to the key contacting member 400, whereby no conductivity through the key is used since the switch S11 is for purposes in which the need is to make possible switching when the key is non-conductive.

The other terminal 924 of the switch S11 is connected to the wire 910 just described and the wire 910 can be seen in FIG. 3 as connected to the door-locking control relay 940 which is itself connected to one of the terminals 942 of the door-locking solenoid 380, earlier described, and which latter has its other terminal grounded at 943.

The door-locking control relay 940 has one terminal grounded at 946 and has its remaining terminal connected at 948 to the heavy current wire 303 seen in FIG. 7, whereby at times when the switch S11 is closed and power from the power source or battery 300 can reach the relay terminal wire 910 through the FIG. 7 wires 303, 420, resistor 430, wire 410, then the energized relay will cause the solenoid 380 to be energized pulling down on its core 382, and thereby pulling down on the plunger 360 and having the same effect as though the plunger 360 was pushed downward by the operator's hand.

This same result of locking the door by pulling down on the plunger 360 is likewise accomplished by energy passing through the wire 910 from the locking contact 900.

Figure 4:
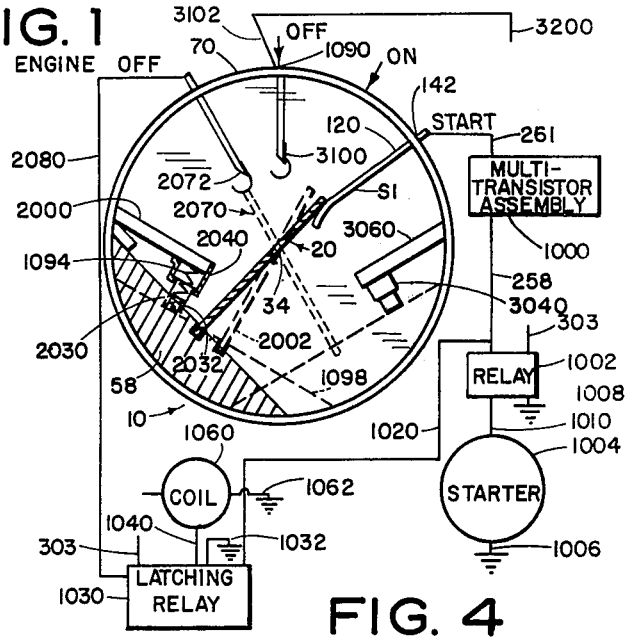
FIG. 4 is a wiring diagram showing how the switch of this invention is related to the starter and ignition coil of an automobile when viewed as an ignition switch.

In FIG. 4 the switch is diagrammatically shown in a view similar to FIG. 5, but simpleified to illustrate its operation as an ignition switch. The door locking switch S11 or door locking contact 900 of FIG. 5 are not needed, although the contact assembly 130 would be made substantially the same and the advantages of having a front and rear alarm associated plate 750 and 804 would remain, although these are not shown in FIG. 4 for convenience of illustration. In FIG. 4 a wire 261 leads from one of the terminals 142 of one of the switches which can be called S1 of the diagram of FIG. 1 to a multitransistor assembly 1000, which latter comprises the resistors $T_1$ to $T_7$ of FIG. 7 and the details of the wiring thereof are not repeated in FIG. 4 for convenience of illustration, it being understood that the numeral 261 serves to illustrate a sample wire and that other wires from other terminals 142 of the various switches $S_1$ to $S_7$ also extend to the multi-transistor assembly 1000 and in the same manner as do the wires 262 to 267 sequentially of the diagram of FIG. 7. The wire 258 from the multitransistor assembly 1000 is a low voltage output wire for relay control and can be seen in FIG. 7 and FIG. 4, although in the wiring diagram of FIG. 4 the wire 258 leads to a relay 1002, which latter has another of its terminals connected to a starter 1004, which latter is grounded at 1006, the relay itself is grounded at 1008 and has one of its terminals connected to the high voltage current wire 303 of FIG. 7 so that high voltage current passes from the relay 1002 through a wire 1010 to the starter 1004.

A low voltage wire 1020 connected to the wire 258 leads to a terminal of a latching relay 1030, which latter is grounded at 1032 and receives heavy current at one of its terminals through the wire 303, heavy current from the latching relay leaving another of its terminals through a wire 1040 extending to a coil 1060 which is grounded at 1062.

As thus described, when the key 20 is inserted in the vertical position, in an alignment with an "Off" mark 1090, it is then turned clockwise to a "start" position at which it engages one of the contacts 120 and also any of the other contacts 120 which the proper key would engage, whereby the transistors of the multi-transistor assembly 1000 which are the transistors $T_1$, $T_2$, $T_4$, $T_6$ and $T_7$ all receive energy from their various contacts 120 so that energy is passed through the wire 258 to the relay 1002 and from there to the starter so that the car starts with other energy reaching the latching relay 1030 so that the ignition coil 1060 is energized and the car will start.

After the operator has turned the key to the start position, he then releases the key and a spring 1094 mounted on a bracket 2000 fixed to the housing 70 urges against the central section 58 of the guide 50 forcing the central section itno a dotted line position shown at 1098 in dotted lines so that the key reaches the dotted position indicated at 2002 at which it no longer contacts the contacts 120.

The key 20 is maintained in the position 2002 because the spring 1094 is prevented from expanding excessively by a telescoping frame assembly 2030 having interlocking parts 2032 and 2040.

With the key in the position 2002, the automobile can be operated.

When the operator desires to stop his car, he turns the key 20 to the position shown at 2070 which is the engine "Off" position. In this position, the key touches the contact 2072 connected by a wire 2080 to the latching relay 1030, whereby the latching relay gets a second impulse which releases its latching so that energy no longer goes to the ignition coil 1060. However, it is to be understood that unless the key is turned to the position 2070, then from the time the key has first touched, the contacts 120 the latching relay will have remained latched energizing the coil 1060.

Figure 8:
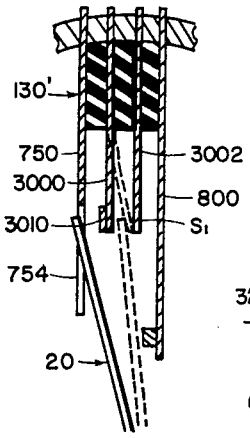
FIG. 8 is a detail showing a modified contact assembly for use with a non-energized key, in which the key and one contact are shown in dotted lines in position for causing that one contact to engage a mating contact, the open position of the two contacts and the key being shown in full lines, the view being substantially as it would be seen along the line 5—5 of FIG. 1, if FIG. 1 contained this modified contact assembly of FIG. 8 but the contacts and key being shown in FIG. 8 as though the entire outer housing were rotated approximately 40° counter-clockwise from the position shown in FIG. 5.

Referring now to FIG. 8, an alternate contact plate assembly is there shown and is generally indicated at 130'. The contact plate assembly 130' has a similar front alarm associated plate 750 and a similar back alarm associated plate 800, but between them, instead of there being a single contact 130 at each cross-section taken at a right angle to the axis 34, there are two contacts 3000 and 3002 so disposed that when the key 20 strikes a contact 3000, it presses that contact to the contact 3002 and since the contacts 3000 and 3002 form the contacts of the switch $S_1$ of the diagram of FIG. 7, therefore, the same diagram of FIG. 7 will work, even though the key in the case of FIG. 8 is non-metallic and non-conductive.

If the switch of the type of FIG. 8 is preferred, even though the key is metallic, then an insulative piece 3010 can be fastened to each contact 3000 to insulate it from the key 20, as shown in FIG. 8.

A second telescoping assembly 3040 similar to the one shown at 2040 and containing a spring and mounted on a bracket 3060 fixed to the housing 70 is shown in FIG. 4 in a position of urging the central part 58 of the guide back from the position in which the key is opposite the engine "Off" station and contact 3072 to a position in which the key is opposite the "Off" station 1090 from which the key can be withdrawn. The engine "Off" station can also be an accessory's position of the car radio and other accessories.

Referring to FIG. 4, a resilient contact 3100 can be seen in a position directly vertically above the axis 34 in a place where it would be contacted by the key only at times when the key is in the vertical plane position of insertion and removal.

A terminal 3102 extending through the housing 70 is connected by a wire 3200 to another terminal of the switch 620, as seen in FIG. 9, whereby at times when the switch 620 closes, the contact between the wire 3200 and the wire 610′, then the wire 3200 is connected to the relay terminal 259.

Alternatively, the wire 3200 could be directly connected to the wire 259, but in either case, the effect is that when the key touches the key-left contact 3100 while the key also touches the end contact 400, the net effect is to make a direct contact between the relay terminal 259 and the end contact 400 of the wiring diagram of FIG. 7, thus by-passing the transistors of FIG. 7 and causing the relay 320 to operate which then itself causes the terminal 342 of FIGS. 3 and 7 to be energized, this energizing the solenoid S which keeps the door lock plungers 360 unlocked for making it impossible for a man to shut and lock his car door at a time when his ignition key is in the ignition at the insertion and removal position. This works because the key, when not being manually twisted, is urged to the vertical position by the spring-loaded telescoping frame assemblies 2030 and 3040.

I claim:

1. An electric lock comprising:

a. a lock housing;

b. a set of flexible electrical, key contacts mounted in said housing, said key contacts being insulated from each other;

c. a set of electrical unlock contacts, mounted in said housing and located proximate to said key contacts, said unlock contacts being insulated from each other;

d. an easily duplicated key having protrusions thereon for directly engaging said flexible key contacts and pressing them directly against said unlock contacts, thereby completing an electrical circuit between said key contacts and said unlock contacts;

e. a rotatable key guide located within said housing and adapted to receive said key;

f. an unlock circuit means electrically connected to each of said unlock contacts and responsive thereto for producing an unlock electrical signal upon insertion of said key into said key guide so as to directly engage each of said flexible key contacts and upon rotation of said key guide to press said key contacts directly against said unlock contacts.

2. The electric lock assembly of claim 1 which includes mounted within said housing electrical alarm contacts which activate an alarm system when an improper key is employed.

3. The electric lock assembly of claim 2 wherein said electrical alarm contacts, mounted in said housing include a first set of flexible alarm contacts, each being insulated from the other, a second set of alarm contacts located proximate to said first set of flexible alarm contacts, and alarm circuit means electrically connected to said second set of alarm contacts and responsive thereto for producing an alarm signal upon insertion of an improper key into said key guide so as to directly engage at least one of said flexible alarm contacts in said first set and press said flexible alarm contact into direct engagement with at least one of said alarm contacts in said second set.

4. A lock assembly comprising:

a. a lock housing;

b. a rotatable key guide within said housing, said key guide being movable from a first position to a second position;

c. a set of flexible electrical key contacts, mounted in said housing, said key contacts being insulated from each other;

d. a set of electrical unlock contacts, mounted in said housing proximate to said key contacts to form a switching circuit, said unlock contacts being insulated from each other;

e. a locking solenoid which is energized upon closing said unlock contacts in said switching circuit;

f. a locking means which is moved from one position to another position when said locking solenoid is energized;

g. the contacts of said switching circuit being closed when an easily duplicated key having prearranged protrusions moves said key guide from said first position to said second position and said protrusions directly engage said key contacts and press said key contacts directly into engagement with said unlock contacts of said switching circuit, completing an electrical circuit between said key contacts and said electrical contacts of said switching circuit, whereby said locking solenoid is energized and said locking means is moved from said one position to said other position.

5. The electric lock assembly of claim 4 which includes mounted within said housing electrical alarm contacts which activate an alarm system when an improper key is employed.

6. The electric lock assembly of claim 5 wherein said electrical alarm contacts, mounted in said housing include a first set of flexible alarm contacts, each being insulated from the other, a second set of alarm contacts located proximate to said first set of flexible alarm contacts, and alarm circuit means electrically connected to said second set of alarm contacts and responsive thereto for producing an alarm signal upon insertion of an improper key into said key guide so as to directly engage at least one of said flexible alarm contacts in said first set and press said flexible alarm contact into direct engagement with at least one of said alarm contacts in said second set.

* * * * *